US006771786B1

(12) United States Patent
Skindhøj et al.

(10) Patent No.: US 6,771,786 B1
(45) Date of Patent: Aug. 3, 2004

(54) HEARING AID INCLUDING AN INTEGRATED CIRCUIT

(75) Inventors: Jørgen Skindhøj, Hellerup (DK); Per K. Sørensen, Hellerup (DK)

(73) Assignee: OTICON A/S, Hellerup (DK)

( * ) Notice: Subject to any disclaimer, the term of this patent is extended or adjusted under 35 U.S.C. 154(b) by 0 days.

(21) Appl. No.: 10/048,066

(22) PCT Filed: Jul. 7, 2000

(86) PCT No.: PCT/DK00/00378

§ 371 (c)(1),
(2), (4) Date: Mar. 18, 2002

(87) PCT Pub. No.: WO01/10167

PCT Pub. Date: Feb. 8, 2001

(30) Foreign Application Priority Data

Jul. 28, 1999 (DE) ..... 1999 01078

(51) Int. Cl.[7] ..... H04R 25/00
(52) U.S. Cl. ..... 381/324; 381/312
(58) Field of Search ..... 381/23.1, 60, 312, 381/322, 175, 324; 174/255, 256, 257, 258, 259

(56) References Cited

U.S. PATENT DOCUMENTS 4,244,040 A * 1/1981 Fondiller et al. ..... 368/69
4,539,441 A 9/1985 Eggert et al.
4,783,815 A 11/1988 Büttner
5,001,762 A * 3/1991 Barwig et al. ..... 381/324
5,063,177 A 11/1991 Geller et al.
5,156,998 A * 10/1992 Chi et al. ..... 438/121
5,195,139 A * 3/1993 Gauthier ..... 381/322
5,657,199 A 8/1997 Devoe et al.
6,118,877 A * 9/2000 Lindemann et al. ..... 381/60
6,323,436 B1 * 11/2001 Hedrick et al. ..... 174/256

FOREIGN PATENT DOCUMENTS

EP 0820099 1/1998
JP 10027866 1/1998

* cited by examiner

*Primary Examiner*—Curtis Kuntz
*Assistant Examiner*—Brian Ensey
(74) *Attorney, Agent, or Firm*—Dykema Gossett PLLC

(57) ABSTRACT

The invention relates to a hearing aid comprising a housing; a microphone; an integrated circuit; a receiver for outputting a signal; where the integrated circuit comprises at least one semiconductor layer including the electric circuit; the at least one layer having an outer circumference; at least one through electrical connection extending from one side of the at least one layer to an opposed other side of the at least one layer; the through electrical connection being established in distance from the outer circumference of the at least one layer. The invention further relates to an integrated circuit for use in a hearing aid as described above.

10 Claims, 3 Drawing Sheets

HEARING AID INCLUDING AN INTEGRATED CIRCUIT

FIELD OF THE INVENTION

Integrated circuits are used in numerous electronic devices for the controlling of various elements of these. One example of such a device is a hearing aid. The invention is especially relevant in connection with hearing aids, due to the desired and often required small size of these. The small size requirement is especially pronounced in connection with the so-called ITE or CIC hearing aids, which are mounted partly or entirely in the ear canal of the hearing aid user. The integrated circuits typically perform the signal processing and the amplification in the hearing aids.

BACKGROUND OF THE INVENTION

There is a tendency towards making at least some of the hearing aids smaller and/or towards applying more functionality to these. In both cases the integrated circuits become a limiting factor as the dimensions of this has to fit into the available physical dimensions of the hearing aid.

The integrated circuits are becoming smaller due to development of the production techniques for these. However the increase in the need for applying more functionality does often exceed the speed of developing the production methods, which means that the field of developing the production cannot entirely fulfill the needs of limiting the size of the integrated circuits.

U.S. Pat. No. 4,783,815 discloses the manufacturing of miniature hearing aids having a multi-layer circuit arrangement. This prior art publication describes a multi-layer pcb having plated through holes. The pcb may be arranged in several layers. The pcb may comprise one or more IC's arranged on and connected to the pcb.

EP 0820099 discloses a packaged semiconductor device and a method of manufacturing this device. The document describes a board being electrically and mechanically connected to an IC by means of laser cut holes in the IC and the board.

Common for these prior art publications are that the IC's described do not provide for the positioning and connection of any components on the rear side of the IC itself. The provision of a board is necessary for holding the IC and the possible further components The state of the art in packaging is chip scale packaging (CSP) in various versions. A chip scale packaging is defined as a package, which has a size less than 1.2 times the size of the chip. CSP's are typically made with solder balls distributed in an area array over the active side of the IC. The CSP is soldered to a circuit board with the active side of the IC facing the circuit board.

The design of the integrated circuit as such is not described in further detail here. The art of designing and manufacturing integrated circuits is disclosed more detailed in the technical literature on this area.

Due to the requirement for the above mentioned connection sites for either discrete component mounting or external connection to the remaining electrical system the CSP has to have a certain size in order to make this mounting possible.

There exists for the above mentioned reasons a need of reducing the physical dimensions of the integrated circuits, while at the same time maintaining a certain space for various connection purposes.

In one aspect an objective of the present invention is to provide a hearing aid, which with an identical physical size makes it possible to provide an increase in functionality, and which is less cumbersome to handle in a manufacturing process, or which by reduced size of the integrated circuit can be handled with essentially the same production tolerances as it is the case by the prior art.

In another aspect an objective is to provide an integrated circuit for a hearing aid which with the same outer dimensions can make it possible to provide an increased functionality and which is easier to handle in a manufacturing process, or which by reduced size of the integrated handle in a manufacturing process, or which by reduced size in the integrated circuit can be handled with essentially the same production tolerance as it is the case by the prior art.

SUMMARY OF THE INVENTION

According to the invention the objectives of the hearing aid is achieved by a hearing aid which includes a housing, a microphone, an integrated circuit and a receiver for outputting a signal, and wherein the integrated circuit includes a semiconductor layer having electric circuitry on a first side, a through electrical connection which extends from the first side to an opposite second side at a location within an outer circumference of the semiconductor layer, and a redistribution layer on the second side. In another embodiment, the hearing aid includes a housing, a microphone, an integrated circuit not connected to a base plate, and a receiver for outputting a signal, and wherein the integrated circuit includes a semiconductor layer with electric circuitry on a first side and a second side opposite the first side, the integrated circuit being mounted within the housing such that the second side faces an interior surface of the housing.

Hereby the dimensions of the integrated circuit circumference are maintained allowing a possibility of increasing the circuitry area, this again allowing the providing of an increased functionality to the hearing aid while maintaining the size of the hearing aid. Due to the placement of solder balls on a rear side of the circuit, more space is available for these, meaning that the handling of such circuitry in a manufacturing process in widely facilitated. By reduced size a considerable area is still left on both sides of the integrated circuit for being provided with solder balls. The mounting of the integrated circuit on a base plate having a larger circumference in order hereby to provide a sufficiently large area for solder balls is no longer necessary, as a sufficient area is available on the two sides of the integrated circuit.

Since the second side of the integrated circuit is facing the interior surface of the housing, it is obvious that the substrate, which is normally provided, has been omitted in this invention. Omitting the substrate leads to a thinner integrated circuit, and hence facilitates the manufacturing of smaller and cosmetically attractive hearing aids. A coating may be provided on the second side without hereby differing from the definition of facing the interior surface of the housing.

In an advantageous embodiment a redistribution layer is provided on at least one side of the integrated circuit, preferably on both sides of the integrated circuit, in order hereby to establish connection sites in distance from the through electrical connections. Hereby the total surface area of both sides of the integrated circuit may be made available for connection sites in the form of solder balls.

In an advantageous embodiment discrete electrical components are mounted on one side of this by means of solder balls in connection with the through electrical connections.

In a further advantageous embodiment at least one connection pad is provided on one side of the integrated circuit.

In a still further advantageous embodiment at least one connection pad is provided on one side and discrete electrical components on the other side.

Advantageously an EEPROM component is mounted on one side and solder balls are provided on the other side. Further possibilities comprise the mounting of a micromechanical device or a second integrated circuit on one side of the integrated circuit.

According to the invention the objectives of the integrated circuit manufacturing aspect is achieved by an integrated circuit which includes a semiconductor layer that has electric circuitry on a first side, a through electrical connecting from the first side to an opposite second side at a location within an outer circumference thereof, and a redistribution layer on the second side.

It should be appreciated that when defining the semiconductor layer comprising electric circuitry, this is the raw semi-conducting material, e.g. silicon, which has been subjected to a process where the semi-conducting elements of the electric circuit have been manufactured in one of the surfaces of the semi-conducting material layer. The further elements which most are often present, e.g. metal layers for establishing electrical contacts to the semi-conducting elements and the insulation layers between the respective metal layers, are not described in this connection as they are implicitly comprised by the definition of an integrated circuit as this is normally interpreted.

The invention is described more detailed in the following description of the prior art and a preferred embodiment of the invention with reference to the drawings.

DESCRIPTION OF THE PREFERRED EMBODIMENT

Figure 1:
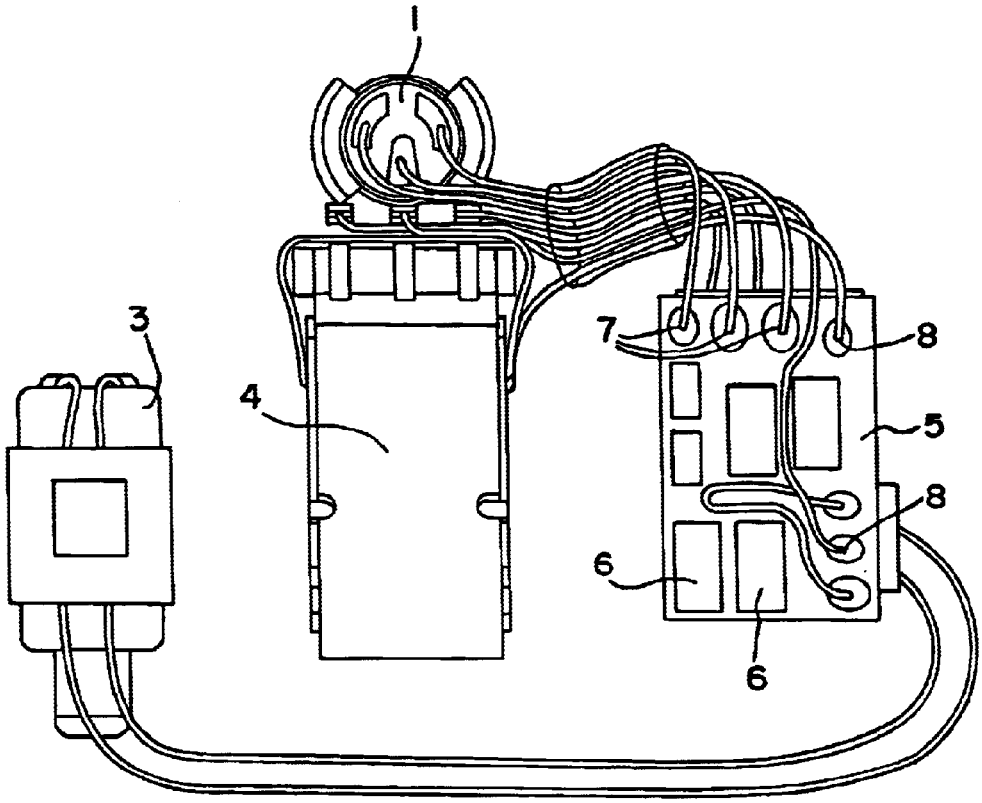
FIG. 1 PRIOR ART
FIG. 1 is a schematic view of the electronics of a typical prior art hearing aid seen from one side.
Figure 2:
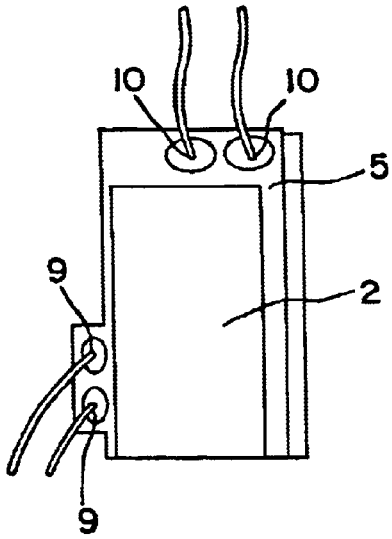
FIG. 2 PRIOR ART
FIG. 2 is a schematic view showing the PCB of FIG. 1 from the opposite side and for clarity showing only the electric leads extending from this side.

Referring to FIG. 1 and FIG. 2, the electronics of a typical prior art hearing aid comprises a microphone 1, an integrated circuit and a receiver 3. The system is powered by a battery 4. The elements of the system are typically connected like shown in FIGS. 1 and 2, i.e., the integrated circuit is mounted on a PCB 5, the side edges of which extend beyond the edges of the integrated circuit 2. The integrated circuit is here a usual construction. The placing of external components, e.g., capacitors 6, requires a rather large surface area, which appears from FIG. 1. It becomes clear that the mounting of these external components and at the same time providing solder bumps 7, 8, 9, 10 for establishing the electrical connections to the microphone 1, the receiver 3 and the battery 4 requires a considerable larger surface area. This means that the PCB 5 on which the integrated circuit is mounted extends beyond the edges of this in order to provide this required space. The amount of space available has also a significant importance in connection with the manufacturing process, where the solder process is widely facilitated when more space is available. When more space is available, larger production tolerances can be accepted and the failure rate decreases significantly.

Figure 3:
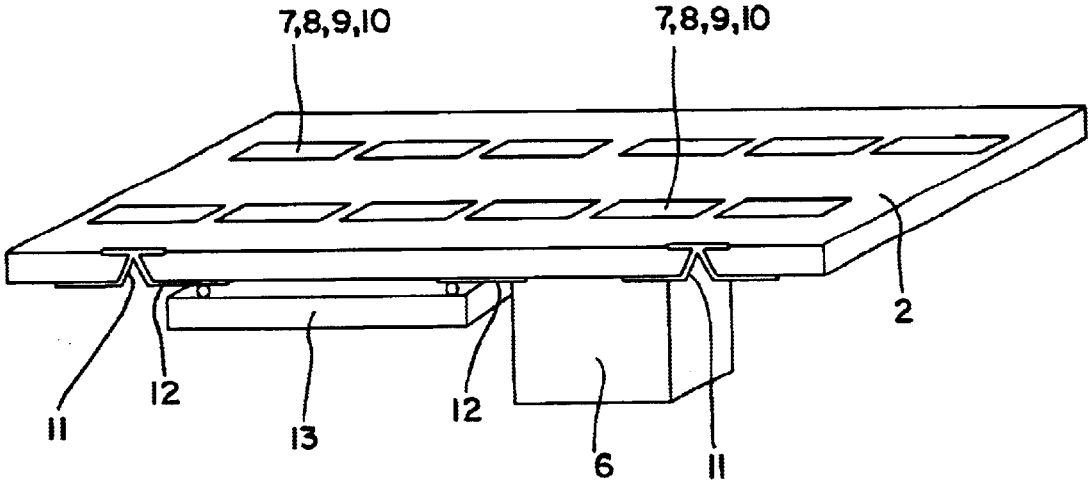
FIG. 3 is a schematic view showing an integrated circuit according to the invention.

Referring to FIG. 3 the integrated circuit comprises a semiconductor layer and superimposed on this a number of metal layers. At the sides and at a small distance from the edge, via's 11 are provided for establishing an electrical connection to the rear side of the integrated circuit 2. After establishing the electrical connection to the rear side, the mounting of a separate capacitor 6 and a separate integrated circuit 13 is realized on a redistribution layer 12 on this side. The solder balls 7, 8, 9, 10 are provided on the one side of the semiconductor layer.

A via is an electrical conducting path which connects electric circuitry on one side of a structure with electric circuitry on the other side of the structure. A via consists of a hole through the structure, an insulation that isolates a conductor from the structure and an electrical conductor inside the insulation.

The holes through the silicon wafer can be of any shape and size. A technical desirable hole would be squares of size 50–150 micron. The holes can be made by wet anisotropic KOH etching or by for example isotropic etching using hydrofluoric acid and nitric acid. The holes can also be made by dry etching, for example reactive ion etching process, or by laser microchemical etching. The inside surface of the hole is covered by an insulating layer. The insulation can be organic or inorganic. An organic insulation can for example be a thin layer of polyimide or BCB. An inorganic insulation can for example be a silicon oxide, silicon nitride or glass passivation layer.

The conductor through the structure is made by a metallization of the insulating surface. The metallization of the hole can be made by electroplating, sputtering or by laser deposition of various metals.

An alternative to making holes through the structure is to change the doping of the silicon locally from both sides thus making an insulated semi-conducting path through the structure. These electrical connections are often designated diffusion plugs.

The redistribution layers are made by a process which allows arbitrary structures in the metal layer and where openings can be made in the insulation layers. Different types of process can be used including electroplating, spincoating, etching, sputtering, etc. A typical process is to spincoat the surface of the wafer with polyimide. Etch holes in the polyimide over the bond-pads of the IC and over the via's. Then metal layers are electro-plated connecting the via's with the bond-pads and the solder pads. Then a second layer of polyimide is spincoated over the wafer and holes are etched over the solder pads. Solder is then electroplated for the solder pads and reflowed to form solderballs or pads for wires or components.

Implementation of the invention may comprise the following embodiments:

Single chip hearing aid amplifier:

WL version. The integrated circuits are made on the silicon wafer. The passive components are mounted on the solder pads on one side of the wafer. The other side of the wafer is used for solder pads for wires. The amplifiers are singulated. CSP version. The passive components are mounted on solder pads on one side of the wafer, the other side is used for solder balls for attach to a printed circuit board.

Multiple chip hearing aid amplifier:

WL version. The largest integrated circuit is made on a silicon wafer. The smaller IC/IC's are mounted on pads on one side of the wafer together with passives, the other side of the wafer is used for solder pads for wires. CSP version. As above but with solder balls for attach to a printed circuit board.

Figure 4:
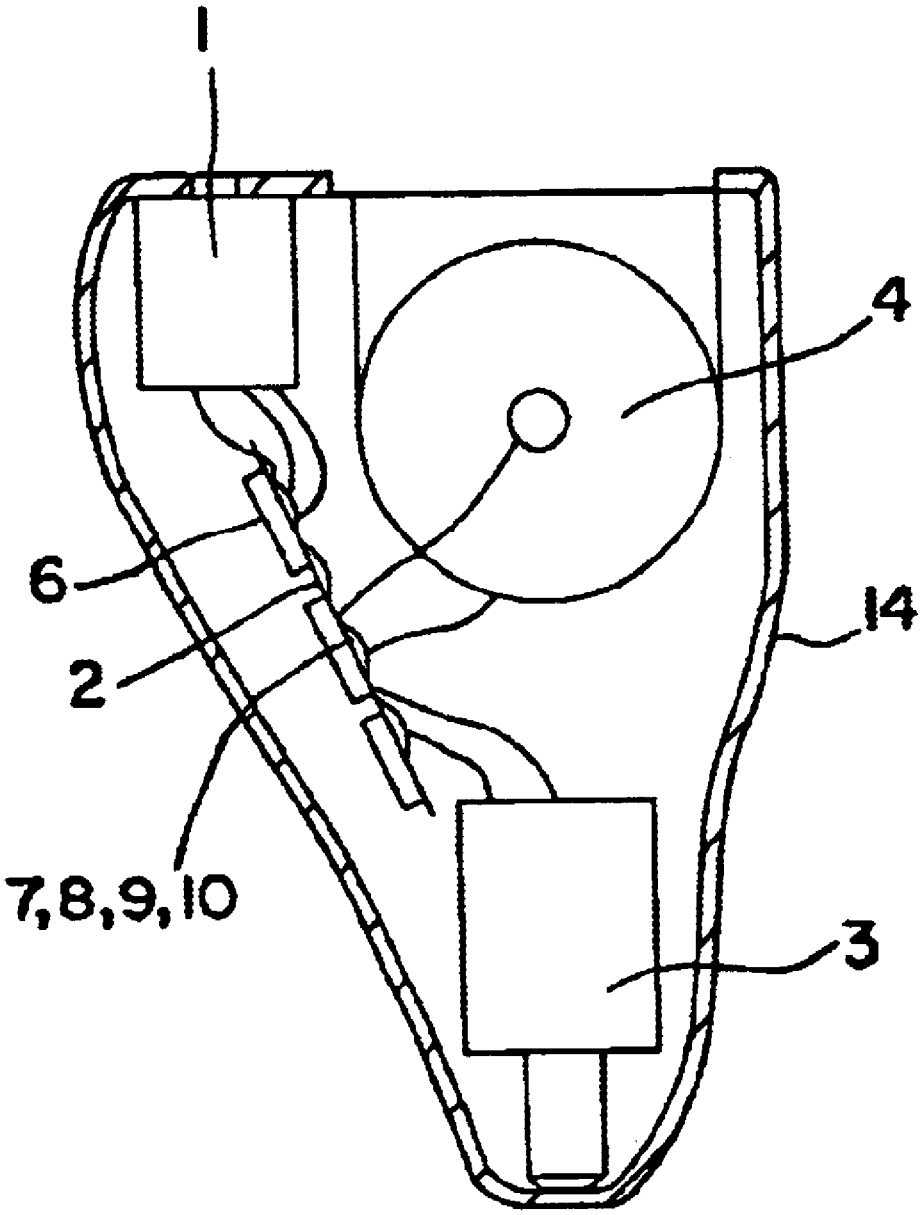
FIG. 4 is a schematic drawing showing a cross section through a hearing aid according to the invention with an integrated circuit according to the invention.

Referring to FIG. 4 a hearing aid appears schematically in a sectional view. The hearing aid comprises a housing 14, which holds a microphone 1, in connection with the microphone an integrated circuit 2 including an amplifier and a signal processor for the hearing aid and in connection with the integrated circuit 2 a receiver 3 for outputting an amplified and processed signal. A battery 4 connected to the amplifier powers the system. It appears that the integrated circuit comprises connection sites on both sides as described in connection with FIG. 3. No base plate is present. This means that the active area of the chip in relation to the available space in the hearing aid housing may be larger than an integrated circuit as normally used, this meaning that more functionality may be added to the integrated circuit, using the same production technology and having the same available space within the hearing aid housing. This provides for a hearing aid having improved properties and therefore is more beneficial for the hearing aid user. Moreover the manufacturing of the hearing aid has been facilitated as more space has been made available for the soldering process and other assembling processes performed during the manufacturing.

What is claimed is:

1. A hearing aid comprising:

housing;

a microphone;

an integrated circuit; and a receiver for outputting a signal;

wherein the integrated circuit comprises;

at least one semiconductor layer including electric circuitry on a first side;

the at least one semiconductor layer having an outer circumference;

at least one through electrical connection extending from the first side of the at least one layer to an opposed second side of the at least one layer;

the through electrical connection being established a distance from the outer circumference of the at least one layer; and wherein a redistribution layer is provided on the second side.

2. A hearing aid according to claim 1, wherein a redistribution layer is provided on the first side of the integrated circuit.

3. A hearing aid according to claim 1, wherein discrete electrical components are mounted on one side by means of solder pads in connection with the through electrical connections.

4. A hearing aid according to claim 1, wherein at least one connection pad is provided on one side of the integrated circuit.

5. A hearing aid according to claim 4, wherein at least one connection pad is provided on one side of the integrated circuit and discrete electrical components on the other side of the integrated circuit.

6. A hearing aid according to claim 1, wherein an EEPROM component is mounted on one side and solder balls are provided on the other side of the integrated circuit.

7. A hearing aid according to claim 1, wherein a micromechanical device is mounted on one side of the integrated circuit.

8. A hearing aid comprising:

a housing having a cavity and an interior surface;

a microphone;

an integrated circuit which is not connected to a base plate; and a receiver for outputting a signal;

wherein the integrated circuit comprises;

at least one semiconductor layer including electric circuitry on a first side and a second side opposite the first side, said integrated circuit being mounted within said cavity and between said microphone and said receiver such that said second side faces the interior surface of the housing.

9. A hearing aid according to claim 8, including a protective coating on the second side.

10. An integrated circuit for a hearing aid, the integrated circuit comprising:

at least one semiconductor layer including electric circuitry on a first side;

the at least one semiconductor layer having an outer circumference;

at least one through electrical connection extending from the first side of the at least one layer to an opposed second side of the at least one layer;

the through electrical connection being established a distance from the outer circumference of the at least one layer wherein a redistribution layer is provided on the second side.

* * * * *